US007281907B2

(12) United States Patent
Gilliam et al.

(10) Patent No.: US 7,281,907 B2
(45) Date of Patent: Oct. 16, 2007

(54) OFFSET MOUNTING FOOT

(75) Inventors: David Rex Gilliam, Bristol, VA (US); David Turner Monk, Bristol, VA (US); Robert Bruce Peters, Bristol, VA (US); William Terry Addison, Bristol, TN (US)

(73) Assignee: Bristol Compressors, Inc., Bristol, VA (US)

( * ) Notice: Subject to any disclaimer, the term of this patent is extended or adjusted under 35 U.S.C. 154(b) by 679 days.

(21) Appl. No.: 10/764,400

(22) Filed: Jan. 23, 2004

(65) Prior Publication Data

US 2005/0053486 A1 Mar. 10, 2005

Related U.S. Application Data

(60) Provisional application No. 60/442,231, filed on Jan. 24, 2003.

(51) Int. Cl.
*F04B 17/03* (2006.01)
*F04B 35/04* (2006.01)
*F16M 1/00* (2006.01)

(52) U.S. Cl. ..... 417/363; 417/415; 248/638

(58) Field of Classification Search ..... 417/363, 417/410.5, 415; 312/351.1; 248/638, 618, 248/189.9, 189.91
See application file for complete search history.

(56) References Cited

U.S. PATENT DOCUMENTS 1,445,617 A 2/1923 Jehu
1,911,804 A 5/1933 Carpenter
3,138,358 A 6/1964 Comstock et al.
3,578,279 A 5/1971 Scheldorf
4,116,583 A 9/1978 Budris
4,917,581 A 4/1990 Richardson, Jr. et al.
4,946,351 A * 8/1990 Richardson, Jr. ..... 417/363
4,964,609 A 10/1990 Tomell
4,964,786 A 10/1990 Maertens
5,174,318 A 12/1992 Dingler et al.
5,252,038 A 10/1993 Mangyo et al.
6,011,336 A * 1/2000 Mathis et al. ..... 310/91
6,039,550 A * 3/2000 Friedley et al. ..... 418/55.6
6,092,284 A * 7/2000 Dreiman et al. ..... 29/890.02
6,132,183 A * 10/2000 Li et al. ..... 417/363
6,336,794 B1 * 1/2002 Kim ..... 417/363
6,354,558 B1 3/2002 Li

* cited by examiner

*Primary Examiner*—Anthony D. Stashick
*Assistant Examiner*—Jessica L Frantz
(74) *Attorney, Agent, or Firm*—McNees Wallace & Nurick LLC

(57) ABSTRACT

A single piece offset mounting foot is positioned between the compressor and the floor of a cabinet for the compressor. The offset mounting foot has a main body having a geometric shape with a top and bottom surface connected by sidewalls that form a perimeter. A depression in the top surface receives a compressor and is offset in the direction of one of the sidewalls. A plurality of substantially equally spaced legs extend outward from the main body. The thickness of the offset mounting foot may be substantially uniform through the main body. The profile of the top surface in the main body is substantially concave forming a bowl-like surface that transitions smoothly from a minimum within the concave surface or concavity to a maximum in the direction toward the periphery and in the direction away from the center of the concavity. The bottom surface of the main body is configured or profiled to contact the floor or base of the cabinet into which the compressor is to be installed.

38 Claims, 5 Drawing Sheets

OFFSET MOUNTING FOOT

FIELD OF THE INVENTION

The present invention is directed to an apparatus for securing a vibrating part to a cabinet or a base, and specifically for mounting a compressor to a cabinet of an air conditioning unit.

BACKGROUND OF THE INVENTION

Compressors used in refrigeration, air conditioning and heat pump systems, hereinafter referred simply as HVAC systems, are normally mounted in an associated unit that houses such a compressor using a mounting plate. The HVAC system normally includes an indoor unit, an outdoor unit and conduit connecting the indoor unit and the outdoor unit. The indoor unit includes a heat exchanger and is designed to distribute conditioned air through the interior of a structure, while the outdoor unit is enclosed in a cabinet that includes a heat exchanger, which exchanges heat with the atmosphere. Refrigerant cycles through the conduit between the heat exchangers. When strictly used as an air conditioner, the refrigerant cools the interior of a structure while removing heat and exchanging it with the atmosphere through the outdoor unit. However, when used as a heat pump, the HVAC system can additionally be used to draw heat from the atmosphere through the heat exchanger in the outdoor unit and transfer and distribute heat to the interior of the structure through the indoor unit. The compressor is usually enclosed within and mounted to the cabinet of the outdoor unit. The mounting plate desirably should reduce the vibrations and resulting noise caused by compressor operation.

Several different types of compressors can be used in HVAC systems. These typically include reciprocating compressors, scroll compressors and rotary compressors, although other types of compressors may be used. Each of these compressors operates in a different manner, and therefore produces different vibrations. Even within a particular type or family of compressors, different sizes within the compressor type or family may produce different vibrations. For example, a large twin piston, reciprocating compressor can produce different characteristic vibrations than a smaller single piston, reciprocating compressor.

It is desirable to reduce the vibration transmitted by the compressor to the cabinet into which it is installed. For many HVAC systems, the compressor is installed in a cabinet referred to as an outdoor unit of the HVAC system, which outdoor unit may be installed on a roof or adjacent to the structure or building. The vibration can be reduced or dampened by the type of mounting used to mount the compressor in the cabinet.

In the past, the compressor has been mounted to the unit using a metal plate, which has provided very little damping of the compressor vibration, the metal plate being a poor damper and a very effective transmitter of the vibration. Different solutions have been used to address vibration damping of compressors mounted within units for different applications. In U.S. Pat. No. 6,354,558 B1, elastomeric grommets are positioned between the feet of the compressor and the base pan upon which it is mounted. The grommets support the weight of the compressor and are radially spaced from its center of gravity to prevent it from tipping. The grommets serve to vibrationally and acoustically isolate the compressor from its support in the unit.

Other solutions to the problem of compressor vibration include the use of internal dampers to reduce the vibration of the compressor moving parts, such as set forth in U.S. Pat. No. 5,252,038. In this approach, springs are mounted on resilient snubbers to dampen the vibration within the compressor housing. U.S. Pat. No. 4,964,786 ('786 patent) and U.S. Pat. No. 4,964,609 ('609 patent) utilize a resilient thermoplastic mounting boot having an upwardly extending rim that corresponds to an annular groove in the compressor, while U.S. Pat. No. 4,917,581 includes an upstanding sidewall that engages, frictionally, the circumferential wall of the compressor. In the '786 patent, the boot is adhesively attached to the compressor, while in the '709 patent, the compressor is frictionally engaged to the boot. The boot is also adhesively attached to a horizontal support surface in the '786 patent, whereas in the '709 patent, the compressor is attached to a horizontal support via bolts. These schemes provide sound and vibration suppression within the appliance cabinet while eliminating the need for hardware welded to the exterior of the compressor housing.

SUMMARY OF THE INVENTION

The present invention is a system for more effectively managing the available space used by a compressor installed in an enclosed space or structure, such as an outdoor cabinet of a HVAC system. The present invention also permits the reduction of the vibration and noise transmitted by a compressor installed in a cabinet such as the outdoor unit of a HVAC system. The system includes a compressor and the cabinet. The cabinet includes a horizontal surface or floor for installation of the compressor. The floor of the cabinet typically includes predetermined mounting locations for positioning a compressor. A single piece offset mounting foot is intermediate the compressor and the horizontal surface or floor of the cabinet. The single piece offset mounting foot and the compressor are secured together as an assembly, and the assembly is positioned on the floor of the cabinet.

The single piece offset mounting foot is comprised of a metallic material of sufficient strength to bear the weight of the compressor. The offset mounting foot has a main body having a geometric shape. In its simplest form, the offset mounting foot is a rectangularly shaped plate, preferably a square-shaped plate, having a top and bottom surface connected by sidewalls that form a perimeter. The bottom surface of the offset mounting foot is in contact with the floor of the cabinet. A depression in the top surface for receiving a compressor is offset in the direction of one of the sidewalls.

In a more preferred embodiment, a plurality of substantially equally spaced appendages or legs extend outward from the main body. Perimeter surface segments of the main body extend between the appendages providing the offset mounting foot a continuous outer perimeter but giving the offset mounting foot an arcuate appearance. The offset mounting foot of this embodiment has a footprint that falls generally within the footprint of the rectangle or square shape described above and includes segments that are cut out from the generally rectangular or square footprint between the appendages. Although the shape in this embodiment is more complex, there is less material making this shape lighter and easier to handle. This overall footprint is important when considering the arrangement as well as the location of compressor connections to maximize the use of available space. The offset mounting foot main body has a first top surface and an opposed bottom surface, with the perimeter surfaces side walls extending between the top and bottom surfaces. The thickness of the offset mounting device may be substantially uniform through the portion that comprises its main body, but it is not necessary to restrict it to a uniform thickness. The offset mounting foot includes a depression in which the top surface drops downward toward the bottom surface to form a concavity. Ideally, the profile of the top surface in the main body is substantially concave forming a cup-like or bowl-like surface that transitions smoothly from a minimum within the concave surface or concavity to a maximum in the direction toward the periphery and in the direction away from the center of the concavity, but the invention is not so restricted. A unique feature of the main body is that the concave, cup-like surface is not in the geometric center of the main body, but rather is offset from the geometric center in the direction of one of the perimeter surface segments joining the appendages. The bottom surface of the main body is configured or profiled to contact the floor or base of the cabinet into which the compressor is to be installed.

Because the concave surface formed in top surface of the main body is offset, the profiles of each of the appendages are not necessarily uniform. Each of the appendages also has a top surface and a bottom surface. Generally, the profile of the top surface of the appendages is such that each appendage top surface reaches its maximum height above the concavity in a portion of the appendage proximate to the main body. Thus, the offset concavity formed in the main body has top surface profile that extends upward and outward toward the outer perimeter of the mounting foot, reaching its maximum near or within the appendages. The profile of the appendages' top surface then decreases distally from the main body. The decreasing profile can be uniform or stepwise. The overall rate of change of the decreasing profile will vary depending upon the location of the appendage with respect to the location of the center of the concavity. If the appendages are not to provide stability to the assembly, the top surface and the bottom surface of each of the appendages can be intermediate between the top surface and the bottom surface of the main body. Each of the appendages includes a small aperture. Each small aperture receives an elastomeric insert that further assists in damping vibrations of the compressor.

The concave or cuplike surface is designed and sized to receive a compressor housing. The compressor housing is fixedly secured to the offset mounting foot to prevent compressor vibrations from moving the compressor from the offset mounting foot during operation. Elastomeric inserts are assembled into the offset mounting foot so that compressor vibrations are further damped.

An important advantage of the present invention is that the offset mounting foot permits the compressor to be installed off-center within the cabinet. This provides more flexibility in optimizing space usage within the cabinet. For example, by rotating the offset mounting device in a predetermined direction, the compressor can be installed in the cabinet in a manner to improve space utilization within the cabinet, with no change in compressor design. The offset mounting foot can be located so that the compressor is located in a corner of the cabinet to increase the useable space within the cabinet. Alternatively, if more space is required along the side of the cabinet, such as to provide better access to fittings or connections, the offset mounting foot can be rotated so as to increase the space between the cabinet and the compressor upon installation.

Another important advantage of the present invention is that the offset mounting foot of the present invention reduces the overall vibration and sound transmitted by the compressor to the cabinet so that the vibration and noise of the assembly is reduced. Each of the appendages or feet of the offset mounting device vibrate at different frequencies. Since the vibrations and their transmittal are related to the surface area and the velocity of the vibration, separating the resonances of the appendages or feet allows the offset mounting foot to reduce the transmission of vibration from the compressor to the cabinet.

Another important advantage of the invention is that the offset mounting foot of the present invention is about the same size as existing mounting devices, so that the offset mounting foot of the present invention can be used interchangeably in cabinets and with compressors using existing mounting feet. There is no need to redesign existing compressors or existing cabinets in order to accommodate the offset mounting foot of the present invention.

Still another advantage of the present invention is that cabinets can be redesigned to be of smaller size and lighter weight because the offset mounting foot can be positioned to permit compressor installation that maximizes the space in the cabinet.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
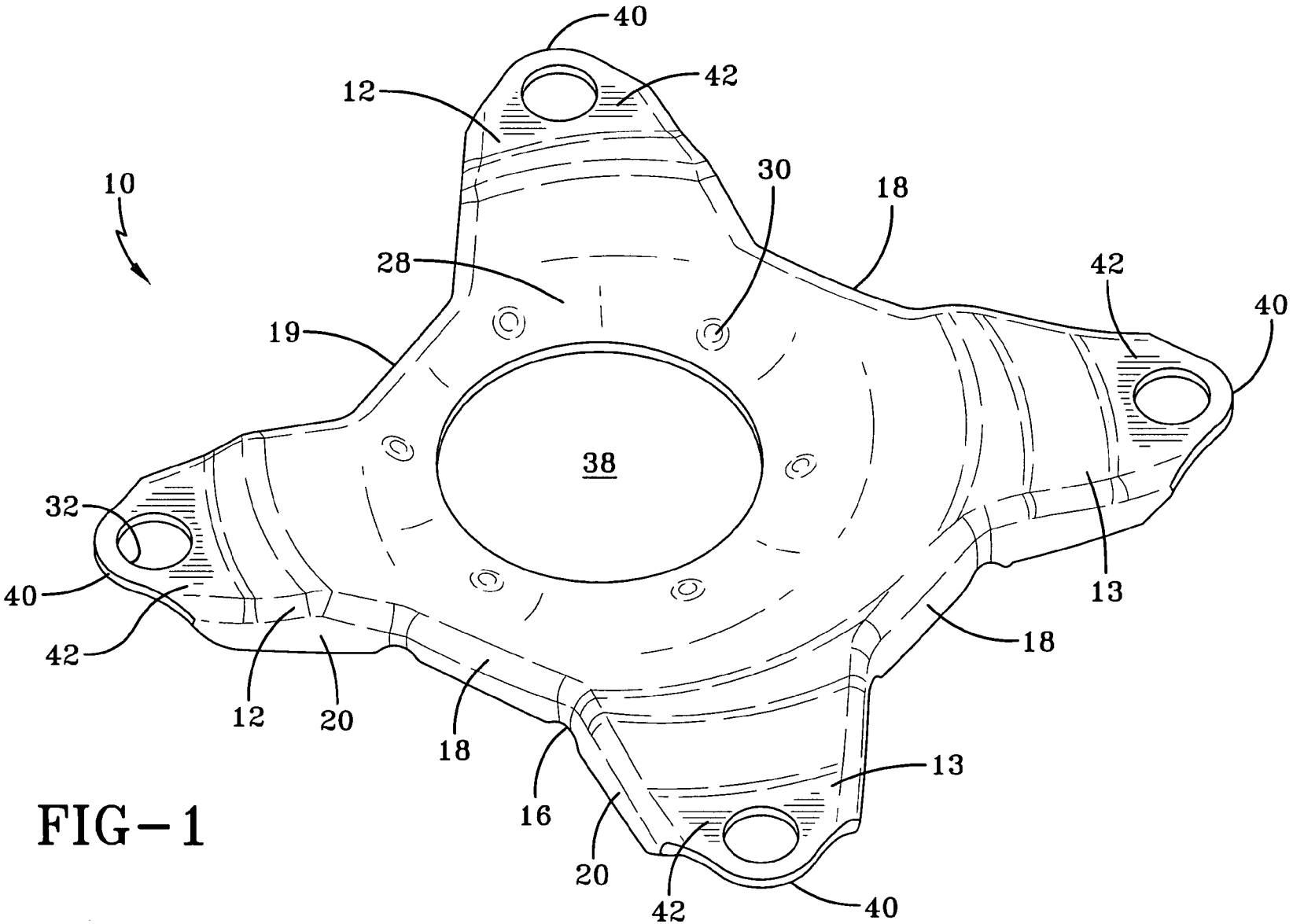
FIG. 1 is a perspective view of an embodiment of the present invention having four appendages.

Referring now to FIG. 1, which is a perspective view of an embodiment of the offset mounting foot 10 of the present invention present invention having four appendages 12, 13 extending outward from a main body 14. The main body 14 can assume any convenient geometric shape, such as a circle, segments of a circle, substantially diamond-shaped, substantially rectangular-shaped, substantially hexagonal-shaped etc., as long as that shape does not depart from the purpose of the invention, which is for the offset mounting foot 10 to accept a compressor. Although this embodiment depicts four appendages 12, 13, the number of appendages 12, 13 need not be limited to four, as fewer appendages, two or three, or additional appendages, such as five, six, or more may extend from the main body 14. However, four appendages 12, 13 are preferred as will become evident.

A substantially continuous perimeter 16 extends along the side of the offset mounting foot 10. The continuous perimeter 16 is formed of perimeter sidewalls 20 of the appendages 12, 13 and perimeter surface segments 18, 19 which extend between the perimeter sidewalls 20 of the appendages 12, 13. Main body 14 includes a top surface 22 and an opposed bottom surface 24 (not visible in FIG. 1). The perimeter surface segments 18, 19 extend between the top surface 22 and bottom surface 24 of the main body.

The top surface 22 of the main body 14 has a profile 28 that is higher near the perimeter sidewalls 20 and decreases to a minimum in the interior. Preferably, the top surface 22 is concave and the transition of the top surface from its maximum height in the vicinity of the perimeter sidewalls to the minimum in the concavity is smooth. Functionally, the profile 28 should be such that it can accept the bottom outer housing of a compressor, as this fit-up feature is the most important aspect for the offset mounting foot 10. The top surface 22 preferably has a profile that is concave because this profile will most frequently match the contour of the bottom outer housing of a compressor with which it is to be mated. However, an important aspect of this invention is that this profile 28 is asymmetric (not symmetric) within main body 14 of the mounting foot. The minimum dimension of profile 28 (thickness, thickness being the distance between the top surface and the bottom surface) is not in the geometric center of main body 14 of the mounting foot 10. Rather, the minimum dimension of profile 28 is offset from the geometric center of main body 14, which is an important aspect of the invention. Preferably, the minimum dimension is offset in the direction of one of the perimeter surface segments, such as perimeter surface segment 19 as shown in FIG. 1. In FIG. 1, the offset is generally toward the midpoint of segment 19, although it should be clear to those skilled in the art that the offset is not so limited, as it also can be in the direction of one of the appendages or any other suitable point so as to create an asymmetric mounting foot.

Main body 14 also includes a plurality of optional bosses 30. These bosses serve to locate a compressor within profile 28. Most typically these bosses 30 are weld projections at which the compressor is attached to offset mounting foot 10 by resistance welding. The bosses facilitate the attachment of the compressor to mounting foot 10; however they are optional as the compressor can be attached to the mounting foot by other means, such as by TIG welding the bottom portion of the compressor housing to the offset mounting foot 10 where the parts contact. Alternate means of fastening the compressor to the offset mounting foot include, such as, for example, providing the compressor with threaded projections that can extend through apertures in the main body of the offset mounting foot. The threaded projections can then be secured with mating threaded parts such as threaded nuts with washers. The offset mounting foot can be designed to include both the optional bosses of the apertures for receiving threaded fasteners. The offset mounting foot 10 with the attached compressor can then be located within a cabinet.

Figure 2:
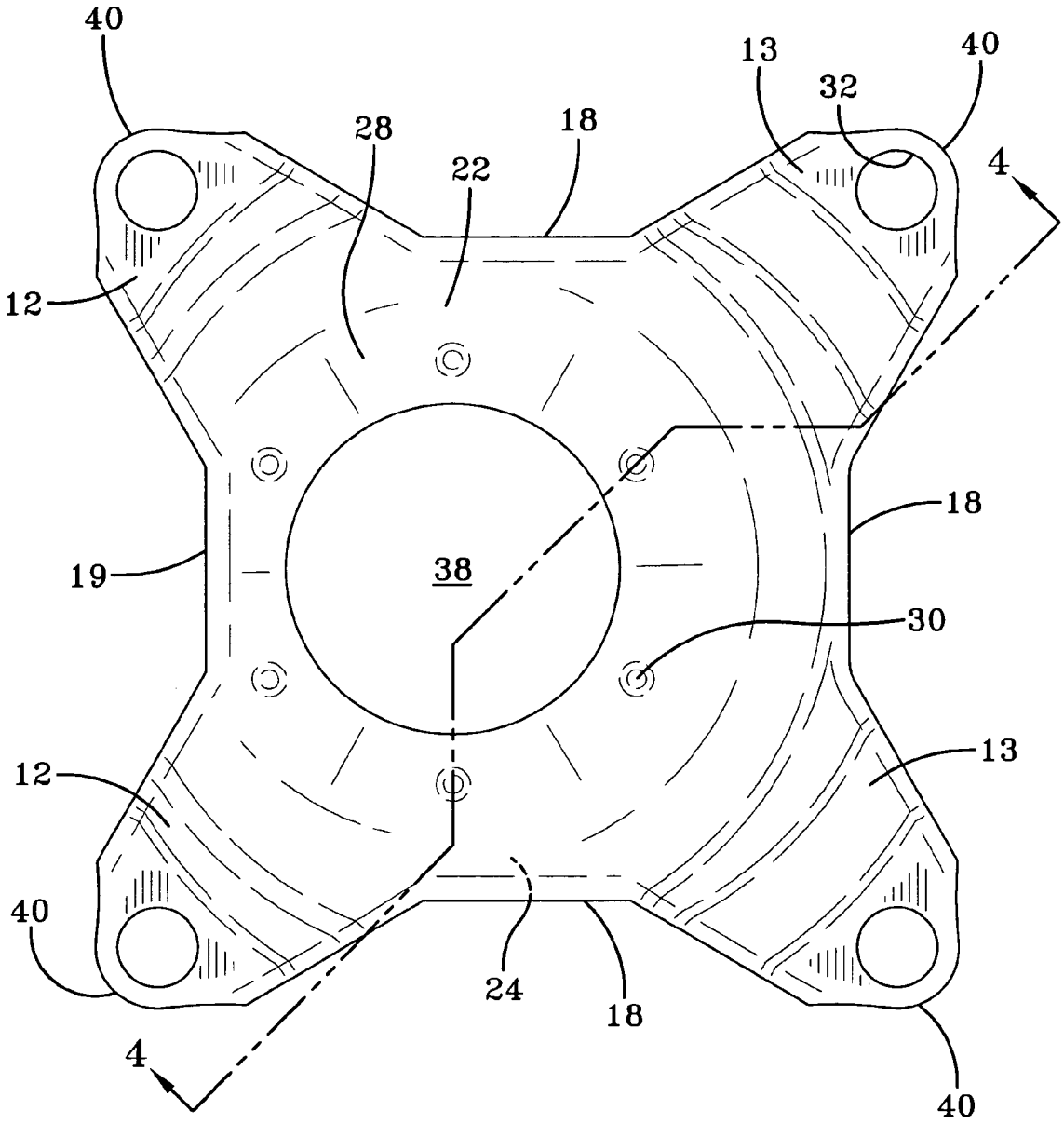
FIG. 2 is a top view of the embodiment shown in FIG. 1

FIG. 2 is a top view of offset mounting foot 10 of FIG. 1. This top view more clearly illustrates the profile of top surface 22. The geometric center of the concavity is not coincident with respect to the geometric center of main body 14 or with respect to the appendages 12, 13, but rather is offset from the geometric center, here in a direction toward perimeter surface section 19 so that the top surface does not have an appearance of symmetry. As illustrated in both FIGS. 1 and 2, a bore 38 extends through the concavity. Ideally, the bore 38 is positioned through the minimum dimension of the offset concavity, ideally with the center of the bore at the lowest point (center) of the concavity in the profile of the top surface 22 of main body 14. The bore is an optional item that can reduce the overall weight of offset mounting foot 10, if weight reduction is desired. The bore is not restricted to the exemplary circular profile shown in the figures and may assume any other geometric profile. The bore includes perimeter walls extending between the top surface and the bottom surface. When present, the diameter of the bore is less than the diameter of the bottom of compressor housing when mounted onto offset mounting foot so that the compressor housing contacts the concave surface of offset mounting foot 10. The bottom of the compressor may extend into and below bore 38, but should not extend below main body bottom surface into contact with the mounting surface of the cabinet into which it is installed. Such contact is undesirable, as it permits vibrations to be directly transferred from the compressor to the cabinet. If further isolation of compressor vibration is desired, a resilient gasket can be installed around the perimeter of bore 38 between the compressor and the concavity, which can further dampen vibrations. Such a gasket can be constructed of the same or similar material as the mounting grommet discussed below. Thus, the size of the bore is limited by the size of the compressor, which is installed on the offset mounting foot. The offset mounting foot adjacent to the bore must include sufficient material to support an installed compressor while not allowing the bottom of an assembled compressor to extend to the bottom surface of the mounting foot.

Figure 3:
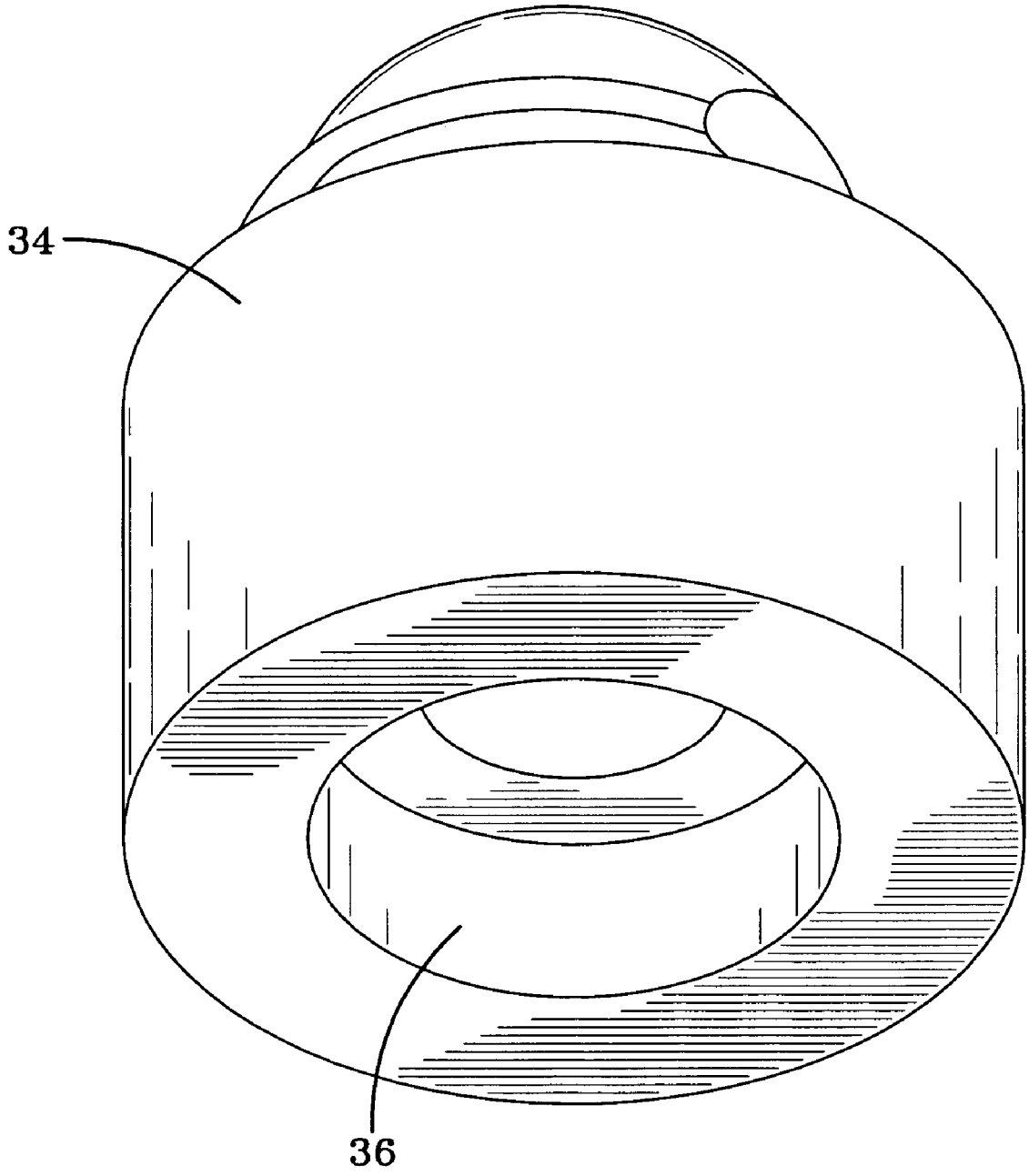
FIG. 3 is a perspective view of a mounting grommet that extends through the appendages of the offset mounting foot of the present invention.

Referring again to FIG. 1, a plurality of appendages 12, 13 are substantially equally spaced about the main body. In the preferred embodiment, each appendage 12, 13 includes an aperture 32. A means for damping, such as a soft mounting grommet made from a resilient elastomeric material such as EPDM rubber or other similar material, is attached to the mounting foot and contacts the floor of the cabinet. Preferably, a mounting grommet is inserted into the aperture and extends away from the compressor and the offset mounting foot, contacting the bottom of the cabinet into which the compressor is mounted. Other means for damping as known to those skilled in the art may be used. A typical mounting grommet 34 is shown in FIG. 3. The mounting grommet 34 assists in damping vibrations from the compressor. Each aperture 36 through grommet 34 receives a locating pin or projection from the cabinet into which the compressor is to be installed. Since the locating pins or projections are currently at four fixed locations within the cabinet in accordance with industry standards (currently on 7.5" centers), the locations of apertures 32 in appendages is predetermined. Thus, while more appendages 12, 13 can be added, cabinets only will accommodate mounting grommets at the existing locations. Furthermore, if fewer than four appendages are utilized in an offset mounting foot, for example, three, the appendages currently must be spaced so that the apertures 32 correspond to the locating pins or projections of the cabinets, which functionally limits the spacing of the appendages. Of course, industry standards may change, or a manufacturer may design a cabinet with a corresponding mounting foot with fewer or more than the existing locating pins or projections, and may place these projections or pins at different locations than set forth by the existing standards. This would allow the spacing of the appendages to vary from the shown from the substantially equal spacing. Although the preferred embodiment of this invention is intended to accommodate industry standards, this invention is intended to accommodate such variations from current industry standards.

As is shown in FIGS. 1 and 2, because the concave profile of top surface 22 of main body 14 is offset from the geometric center of main body 14, the appendages are not identical. As shown in the exemplary figures, the profile of top surface 22 is offset toward perimeter surface segment 19, which also means that it is offset in the direction of appendages 12 and away from appendages 13. When main body 14 is sufficiently large to completely accommodate the concavity, which forms the profile of top surface 22, all appendages can be identical. However, a large main body adds weight to the structure and also undesirably makes it more difficult to install. In the preferred embodiment, concavity forming the profile rises to a maximum within the appendages, the maximum occurring near the edge of appendages 13 where the appendages meet main body 14. However, the concavity forming the profile extends well beyond main body 14 and significantly into appendages 12 before reaching a maximum. In all the appendages 12, 13, after reaching a maximum, the profile of the top surface of the appendages decreases outwardly toward the edge 40 of appendages 12, 13 distal from main body 14. As shown in FIGS. 1 and 2, the profile of the appendages, after achieving a maximum, decreases in stepwise fashion as surfaces decreasing in height radially toward edges 40 and distal from the main body 14. The stepwise appearance is due to a change in the rate of the slope as the edge 40 is approached. Because appendages 13 have a greater length over which to transition from the maximum height, the transition can be accomplished with a longer gradual radius change or taper than occurs in appendages 12. In other words, the slope is more gentle in appendages 13 than in appendages 12. The last portion 42, which is substantially identical in each of appendages 12, 13, is substantially parallel to the base or floor to which the offset mounting foot is to be assembled. Apertures 36 are substantially perpendicular to last portion 42 so as to maximize the contact of grommets 34 with the base or floor of the cabinet.

Figure 4:
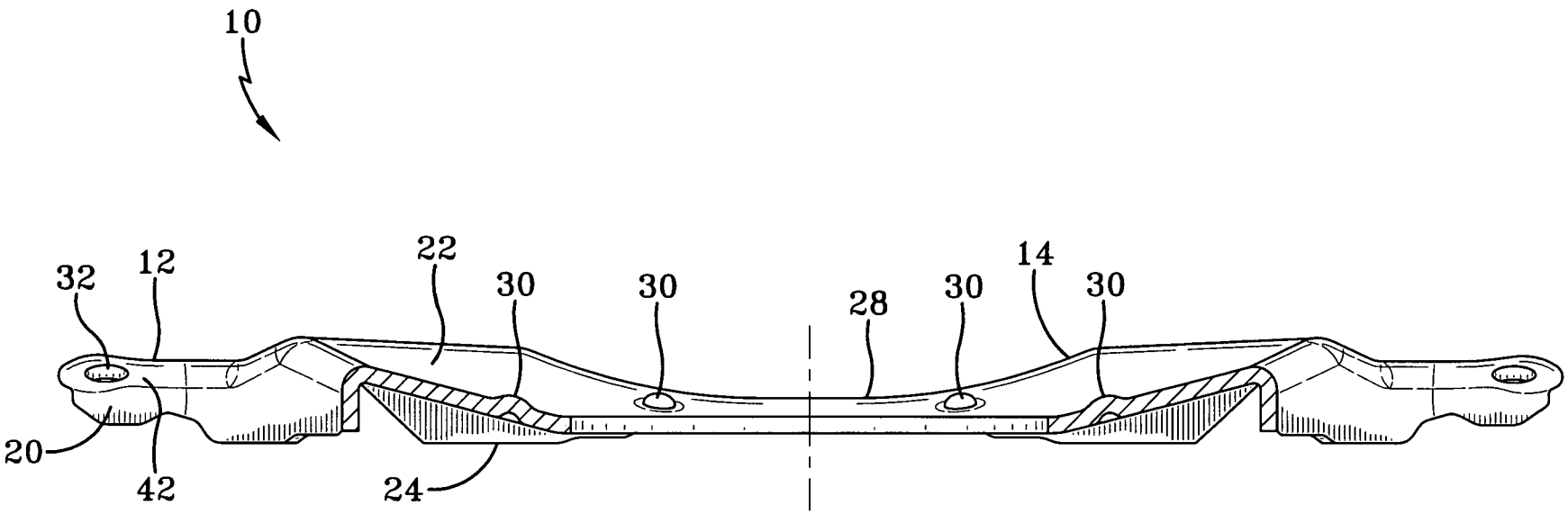
FIG. 4 is a cross section of the present invention through an appendage and the offset concavity formed in the top surface of the offset mounting foot shown in FIG. 1
Figure 5:
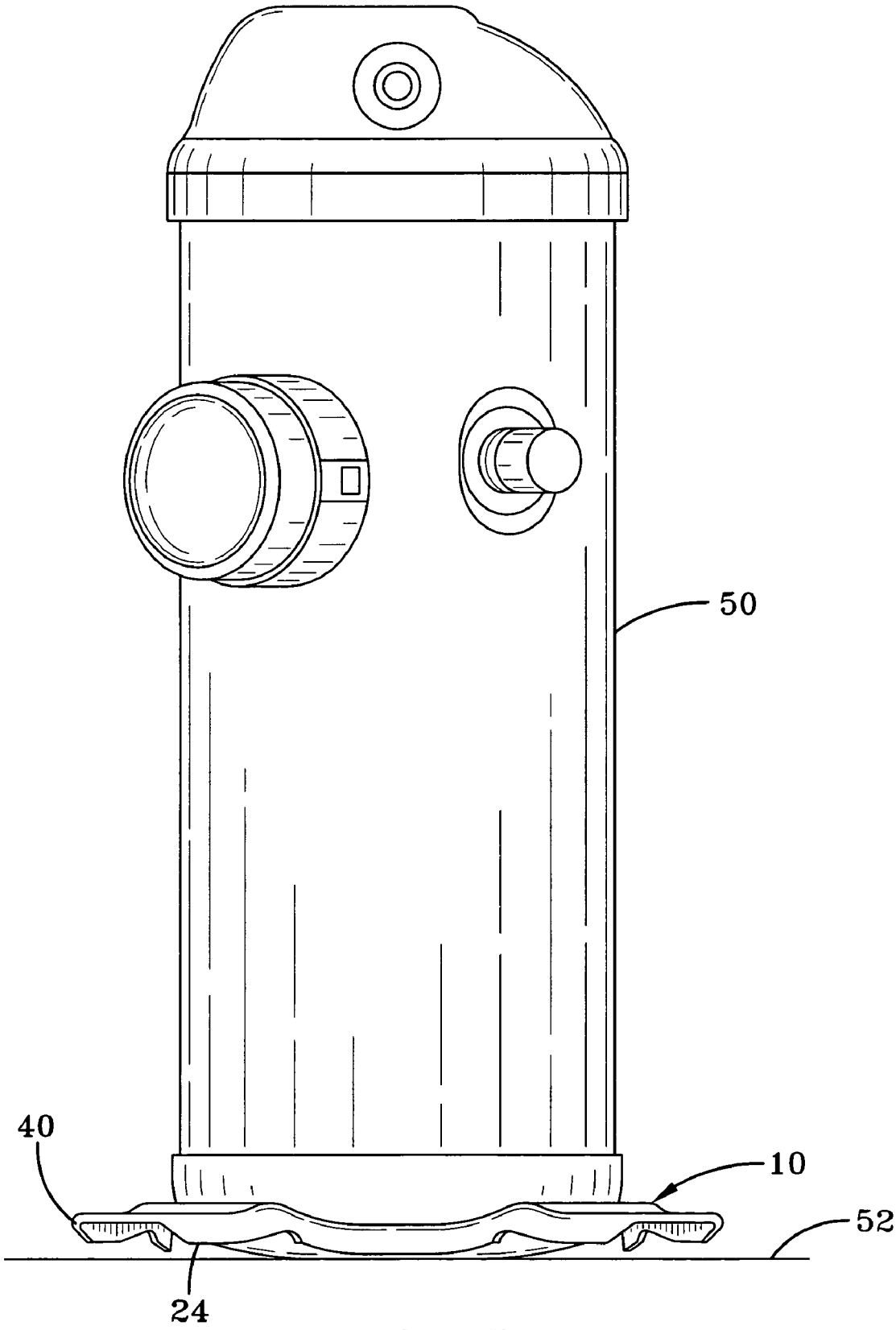
FIG. 5 is schematic of a compressor assembled onto an offset mounting foot of the present invention.

The edge 40 of appendages 12, 13 lies between the maximum height achieved along the top surface of main body 14 and appendages 12, 13 as can best be seen by references to FIGS. 4 and 5. FIG. 4 is a cross section of the present invention through an appendage 12 and the offset concavity formed in the top surface of the offset mounting foot 10 shown in FIG. 1. FIG. 5 is schematic of a compressor 50 assembled onto an offset mounting foot 10 of the present invention. As can be seen, bottom surface 24 of main body 14 will contact the floor 52 or base of the cabinet at several points in cross-section, which represent an area of contact, which may be substantially concentric, between offset mounting foot 10 and the cabinet floor or base. As shown in the figures, the appendages do not contact the cabinet floor or base. Rather, the appendages are situated above the cabinet floor or base, but below the maximum height achieved by the concavity along either the main body or along the appendages. The mounting grommet 34, not shown in FIG. 5, will extend through apertures 26 and contact the floor or base of the cabinet as discussed above. Because appendages 12, 13 are isolated from contact with the floor or base by mounting grommet 34, they should not transmit vibrations to the cabinet, or if vibrations are transmitted, they will be damped. Any vibrations will be damped completely or substantially by the elastomeric and resilient mounting grommet 34.

While the present invention may be made by any well-known manufacturing process, including machining, casting or forging, and can be made from any material that is sufficiently strong to hold a compressor and can withstand a large number of vibrations without experiencing fatigue failure, the most economical method of manufacturing currently available is stamping of sheet metal stock. The starting material is steel having a thickness of between about 0.060 inches to about 0.250 inches, preferably however, 12 and 13 gage steel. The steel can be a carbon steel, a high strength low alloy (HSLA) steel, if additional strength is required, or a corrosion resistant stainless (CRES) steel if environmental conditions indicate that corrosion is or may be a problem. Of course, there is nothing to preclude the use of plastic materials that can be made by a variety of processes including but not limited to blow molding, injection molding etc, as long as the plastic material is sufficiently strong to hold a compressor and has sufficient fatigue resistance to withstand the cyclical vibrational stresses transmitted by the compressor. Certainly, composite materials are available having sufficient strength and fatigue resistance. These materials have a weight advantage over metal materials such as steel. While these materials are technically acceptable, they cannot currently compete economically with the low cost of stamped steel mounting feet, which is currently the preferred offset mounting foot material and method of manufacture.

Although the offset mounting foot 10 of the present invention provides a tool that can be used to reduce the spatial envelope of a compressor mounted in a cabinet by allowing the compressor to be mounted toward an edge of the foot, the offset mounting foot of the present invention provides the unexpected advantage of reducing noise and reducing the vibrations transmitted to the cabinet in which the compressor is mounted. In the offset mounting foot 10 of the present invention, the four resilient grommets vibrate at different frequencies. Since these vibrations are related to the surface area and the velocity at which the vibrations are moving, separating the resonances at the four resilient grommets helps to reduce the effects of the mounting foot on the overall vibrational power of the compressor. In the sonic frequency range, this translates into reduced sound power and a compressor that sounds quieter.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for improving space allocation in an HVAC system structure, the system comprising:

an outdoor cabinet, the cabinet having a floor;

a reciprocating compressor having a housing with an upper housing section and a lower housing section and connections to the unit further comprising a suction tube connection, a discharge tube connection and an electrical connection;

an offset mounting foot having a main body with a top surface, an opposed bottom surface and perimeter surface side walls extending between the top and bottom surfaces, the top surface including a depression having a center point that is offset in a direction of one of the perimeter surface sidewalls, the depression conforming to at least a portion of the compressor lower housing so as to receive the compressor on installation onto the floor of the cabinet, the compressor suction tube connection, discharge tube connection and electrical connection falling within a volume extending upward from the offset mounting foot, wherein the footprint provides the base area for the upwardly extending volume;

means for damping attached to the offset mounting foot and contacting the cabinet floor; and means for assembling the compressor and the offset mounting foot together to form an assembly, the compressor centered in the top surface depression, the bottom surface of the offset mounting foot being the bottom surface of the assembly and installed onto the floor of the cabinet.

2. The system of claim 1 wherein the offset mounting foot includes a plurality of bosses and the means for assembling the compressor to the offset mounting foot to form an assembly includes welding the compressor housing to the bosses.

3. The system of claim 1 wherein the offset mounting foot includes a plurality of apertures and the means for assembling the compressor to the offset mounting foot includes a plurality of threaded fasteners extending through the apertures to secure the compressor to the mounting foot.

4. The system of claim 3 wherein the plurality of threaded fasteners includes threaded bolts extending through the apertures and threaded nuts with washers attached to the threaded bolts to secure the compressor to the mounting foot.

5. The system of claim 1 wherein the offset mounting foot further includes a plurality of appendages extending from the main body, each appendage including an aperture, each aperture positioned at a predetermined location to correspond to a locating pin in the floor of the cabinet.

6. The system of claim 5 wherein the means for damping are assembled through the aperture in each appendage in the plurality of appendages.

7. The system of claim 5 wherein the means for damping is a resilient elastomeric grommet.

8. The system of claim 7 wherein the resilient elastomeric grommet is comprised of EPDM rubber.

9. The system of claim 1 wherein the offset mounting foot further includes a bore extending between the top surface and the bottom surface, the bore center located at about the minimum distance between the top surface and the bottom surface, the bore sized to receive the compressor housing so that the compressor housing when assembled to the offset mounting foot does not extend through the bore below the bottom surface of the mounting foot.

10. A system for improving space allocation in an HVAC system structure, the system comprising:

an outdoor cabinet, the cabinet having a floor;

a reciprocating compressor having a housing with an upper housing section and a lower housing section and connections to the unit further comprising a suction tube connection, a discharge tube connection and an electrical connection;

an offset mounting foot having a main body with a top surface, an opposed bottom surface and perimeter surface side walls extending between the top and bottom surfaces, the bottom surface being installed onto the floor of the cabinet, the offset mounting foot further including a main body, a plurality of appendages extending from the main body with perimeter surface segments forming a portion of the perimeter surface sidewalls extending between the appendages, the top surface including a depression having a center point that is offset in a direction of one of the perimeter surface segments, the depression conforming to at least a portion of the compressor lower housing section so as to receive the compressor on installation onto the floor of the cabinet, the compressor suction tube connection, discharge tube connection and electrical connection falling within a footprint for the offset mounting foot, wherein the footprint is a rectangular area into which the perimeter of the offset mounting foot can be arranged;

means for damping attached to the offset mounting foot and contacting the cabinet floor; and means for assembling the compressor and the offset mounting foot together to form an assembly, the compressor centered in the top surface depression, the bottom surface of the offset mounting foot being the bottom surface of the assembly and installed onto the floor of the cabinet.

11. The system of claim 10 wherein the offset mounting foot includes a plurality of bosses and the means for assembling the compressor to the offset mounting foot to form an assembly includes welding the compressor housing to the bosses.

12. The system of claim 10 wherein the offset mounting foot includes a plurality of apertures and the means for assembling the compressor to the offset mounting foot includes a plurality of threaded fasteners extending through the apertures to secure the compressor to the mounting foot.

13. The system of claim 12 wherein the plurality of threaded fasteners includes threaded bolts extending through the apertures and threaded nuts with washers attached to the threaded bolts to secure the compressor to the mounting foot.

14. The system of claim 10 wherein each appendage in the plurality of appendages of the offset mounting foot including an aperture, each aperture positioned at a predetermined location to correspond to a locating pin in the floor of the cabinet.

15. The system of claim 14 wherein the means for damping are assembled through the aperture in each appendage in the plurality of appendages.

16. The system of claim 15 wherein the means for damping is a resilient elastomeric grommet.

17. The system of claim 16 wherein the resilient elastomeric grommet is comprised of EPDM rubber.

18. The system of claim 10 wherein the offset mounting foot further includes a bore extending between the top surface and the bottom surface, the bore center located at about the minimum distance between the top surface and the bottom surface, the bore sized to receive the compressor housing while avoiding contact with the cabinet floor.

19. An offset mounting foot for attachment of a reciprocating compressor, comprising:

a top surface;

a bottom surface;

sidewalls connecting the top surface to the bottom surface to form a main body having a geometric shape, the sidewalls forming a perimeter around the main body;

the top surface having a profile generally in the form of a concavity, a center point of the concavity, where the top surface achieves its closest approach to the bottom surface, being offset in a direction of one of the sidewalls forming the perimeter, and the concavity receiving the shell of a reciprocating compressor.

20. The offset mounting foot of claim 19 wherein the geometric shape of the main body is substantially rectangular.

21. The offset mounting foot of claim 19 wherein the geometric shape of the main body is substantially square.

22. The offset mounting foot of claim 19 where the geometric shape of the main body is substantially circular.

23. The offset mount foot of claim 19 further including a plurality of appendages extending outward from the main body, the appendages having top and bottom surfaces contiguous with the main body and having perimeter surface segments joining the top surfaces of the appendages to the bottom surface of the appendages, the perimeter surface segments of the appendages and the sidewalls of the main body forming a continuous outer perimeter.

24. The offset mounting foot of claim 23 wherein top surface smoothly transitions from the low point of the concavity to a high point toward an appendage of the plurality of appendages.

25. The offset mounting foot of claim 23, wherein each appendage includes an aperture, each aperture positioned at a predetermined location.

26. The offset mounting foot of claim 23 wherein the low point of the concavity is offset in a direction of one of the appendages.

27. The offset mounting foot of claim 23 wherein the concavity forms the profile of the top surface and a high point of the top surface is reached in at least one of the appendages.

28. The offset mounting foot of claim 27 wherein the high point is reached in at least one of the appendages proximate to where the appendages join the main body, and the profile of the top surface of the appendages transitions downward from the high point toward a distal edge of the appendages away from the main body.

29. The offset mounting foot of claim 28 wherein the transition downward toward the distal edge of the appendages is a stepwise downward transition.

30. The offset mounting foot of claim 23 wherein a distal edge away from the main body of at least one appendage of the plurality of appendages has a bottom surface that lies between a plane that includes the bottom surface of the main body and a plane that includes the top surface of the distal edge of the appendage.

31. The offset mounting foot of claim 19 wherein top surface smoothly transitions from the low point of the concavity to a high point toward the perimeter.

32. The offset mounting foot of claim 19 further including means for attaching the compressor housing to the mounting foot.

33. The offset mounting foot of claim 32 wherein the means for attaching the compressor to the housing includes a plurality of bosses for welding the housing to the mounting foot.

34. The offset mounting foot of claim 32 wherein the means for attaching the compressor to the housing includes a plurality of apertures for accepting threaded fasteners.

35. The offset mounting foot of claim 19 including a bore extending through the top surface and the bottom surface and centered at about the low point of the concavity, the bore of pre-selected size to accept a compressor housing so that the compressor housing does not extend below a plane that includes the bottom surface.

36. The offset mounting foot of claim 19 wherein the concavity forms the profile of the top surface and the concavity is completely accommodated within the main body, and wherein a high point is reached in the top surface at the sidewalls and inward.

37. The offset mounting foot of claim 19 wherein the offset mounting foot is steel.

38. The offset mounting foot of claim 37 wherein the steel has a thickness of from about 0.060 inches to about 0.250 inches.

* * * * *